US010919297B2

(12) United States Patent
Yamaguchi et al.

(10) Patent No.: US 10,919,297 B2
(45) Date of Patent: Feb. 16, 2021

(54) LIQUID EJECTION HEAD AND LIQUID EJECTION DEVICE

(71) Applicant: KONICA MINOLTA, INC., Tokyo (JP)

(72) Inventors: Hironobu Yamaguchi, Tachikawa (JP); Takashi Matsuo, Suita (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/625,264

(22) PCT Filed: May 30, 2018

(86) PCT No.: PCT/JP2018/020754
§ 371 (c)(1),
(2) Date: Dec. 20, 2019

(87) PCT Pub. No.: WO2018/235552
PCT Pub. Date: Dec. 27, 2018

(65) Prior Publication Data

US 2020/0215819 A1 Jul. 9, 2020

(30) Foreign Application Priority Data

Jun. 22, 2017 (JP) ..... JP2017-121816

(51) Int. Cl.
*B41J 2/14* (2006.01)
*B41J 2/16* (2006.01)

(52) U.S. Cl.
CPC ..... *B41J 2/1433* (2013.01); *B41J 2/14233* (2013.01); *B41J 2/16* (2013.01); *B41J 2002/14338* (2013.01)

(58) Field of Classification Search
CPC ..... B41J 2/14; B41J 2/16; B41J 2/175; B41J 2/18; B41J 2/1433; B41J 2/14233;
(Continued)

(56) References Cited

U.S. PATENT DOCUMENTS

2003/0063171 A1* 4/2003 Otsuka ..... B41J 2/055 347/94
2005/0036007 A1* 2/2005 Watanabe ..... B41J 2/14209 347/68

(Continued)

FOREIGN PATENT DOCUMENTS

JP 2012519095 A 8/2012

OTHER PUBLICATIONS

International Search Report corresponding to PCT/JP2018/020754; dated Jul. 3, 2018.

(Continued)

*Primary Examiner* — Anh T Vo
(74) *Attorney, Agent, or Firm* — Cantor Colburn LLP

(57) ABSTRACT

Provided is a liquid ejection head including: a liquid ejection part including a pressure chamber, a nozzle, and a liquid discharge flow path; a liquid storage part including a supply liquid chamber and a discharge liquid chamber; and a flow path part including an intermediate supply flow path and an intermediate discharge flow path. The intermediate supply flow path and the intermediate discharge flow path are formed such that a minimum distance between an opening of the intermediate supply flow path on a side facing the liquid storage part and an opening of the intermediate discharge flow path on the side facing the liquid storage part is greater than a minimum distance between a liquid inlet and a liquid discharge outlet on a predetermined first opening forming surface.

8 Claims, 10 Drawing Sheets

(58) Field of Classification Search
CPC .... B41J 2002/14241; B41J 2002/14338; B41J 2002/14459; B41J 2002/14491; B41J 2202/11; B41J 2202/12
See application file for complete search history.

(56) References Cited

U.S. PATENT DOCUMENTS

2005/0157104 A1* 7/2005 Hirota ..... B41J 2/17513 347/85
2006/0139415 A1* 6/2006 Taira ..... B41J 2/1623 347/71

OTHER PUBLICATIONS

PCT International Preliminary Report on Patentability with Written Opinion of the ISA corresponding to International Application No. PCT/JP2018/020754 dated Dec. 24, 2019 with English translation.

* cited by examiner

LIQUID EJECTION HEAD AND LIQUID EJECTION DEVICE

CROSS REFERENCE TO RELATED APPLICATIONS

This is the U.S. national stage of application No. PCT/JP2018/020754, filed on May 30, 2018. Priority under 35 U.S.C. § 119(a) and 35 U.S.C. § 365(b) is claimed from Japanese Patent Application No. 2017-121816, filed Jun. 22, 2017; the disclosures of which are incorporated herein by reference.

TECHNOLOGICAL FIELD

The present invention relates to a liquid ejection head and a liquid ejection device.

BACKGROUND ART

Conventionally, there have been liquid ejection devices in which liquid such as ink is ejected from nozzles disposed on a liquid ejection head to land at desired positions to form an image or a miniscule structure. There have been also liquid ejection heads of liquid ejection devices in which liquid supplied through the liquid inlet is stored in pressure chambers and liquid is ejected from the nozzles by change in pressure of liquid in the pressure chambers.

In such liquid ejection heads, when air bubbles or foreign objects get in a pressure chamber, pressure is not applied to liquid normally, causing a failure of liquid ejection from a nozzle. Thus, there has been a technique, conventionally, in which liquid supplied to a pressure chamber is discharged with air bubbles and foreign objects via a liquid discharge flow path which is disposed in a liquid ejection part, branched from an ejection outlet between an inlet of liquid of a pressure chamber and an opening of a nozzle. As a liquid ejection head with such a liquid discharge flow path, there has been known one with a structure in which the above-described liquid inlet and a liquid discharge outlet of the liquid discharge flow path are formed on a predetermined opening forming surface of a liquid ejection part (head chip) with pressure chambers and nozzles, and a supply liquid chamber for storing liquid to be supplied to the liquid inlet and a liquid storage with a discharge liquid chamber to which liquid discharged through the liquid discharge outlet is directed are connected on the said opening forming surface (for example, Patent Literature 1).

CITATION LIST

Patent Literature

Patent Literature 1: JP 2012-519095 A

SUMMARY

Technical Problem

However, the number of the liquid inlets on the surface with openings increases as the number of the nozzles in the liquid ejection head, and it is difficult to maintain sufficient space between the liquid inlet and the liquid discharge outlet. A smaller distance between the liquid inlet and the liquid discharge outlet may results in a failure of appropriate communication between the supply liquid chamber and the liquid inlet and between the discharge liquid chamber and the liquid discharge outlet due to a slight mispositioning of the liquid ejection part and the liquid storage. Therefore, there is a problem that it is not facile to manufacture a liquid ejection head with the above-mentioned structure as designed because precise positioning of the liquid ejection part and the liquid storage is necessary.

An object of the present invention is to provide a liquid ejection head and a liquid ejection device that can be manufactured more easily.

Solution to Problem

In order to achieve at least one of the abovementioned objects, the invention is directed to a liquid ejection head including:

a liquid ejection part including: a pressure chamber that stores liquid supplied from a liquid inlet formed on a predetermined first opening forming surface; a nozzle that ejects liquid supplied from the pressure chamber according to change in pressure of liquid in the pressure chamber; and a liquid discharge flow path that is branched from an ejection flow path between an inlet of liquid of the pressure chamber and an opening of the nozzle and that directs liquid supplied to the pressure chamber to a liquid discharge outlet formed on the first opening forming surface;

a liquid storage part including: a supply liquid chamber that stores liquid to be supplied to the pressure chamber through the liquid inlet; and a discharge liquid chamber to which liquid is directed from the liquid discharge outlet, wherein the liquid storage part has a liquid supply opening through which liquid flows out of the supply liquid chamber and a discharge liquid inlet through which liquid flows in to the discharge liquid chamber, wherein the liquid supply opening and the discharge inlet are formed on a predetermined second opening forming surface; and a flow path part that is disposed between the first opening forming surface of the liquid ejection part and the second opening forming surface of the liquid storage part and that includes an intermediate supply flow path to direct liquid from the liquid supply opening to the liquid inlet and an intermediate discharge flow path to direct liquid from the liquid discharge outlet to the discharge liquid inlet;

wherein the intermediate supply flow path and the intermediate discharge flow path are formed such that a minimum distance between an opening of the intermediate supply flow path on a side facing the liquid storage part and an opening of the intermediate discharge flow path on the side facing the liquid storage part is greater than a minimum distance between the liquid inlet and the liquid discharge outlet on the first opening forming surface.

In an embodiment, the flow path part includes a layered plurality of plate members, and a supply through hole that forms part of the intermediate supply flow path and a discharge through hole that forms part of the intermediate discharge flow path are formed in each of the plurality of plate members.

In an embodiment, an area of a discharge through hole of at least one plate member of the plurality of plate members is greater than an area of a discharge through hole of a plate member next to a liquid discharge part-side of the at least one plate member.

In an embodiment, the liquid inlet includes a plurality of liquid inlets, the pressure chamber includes a plurality of pressure chambers, the nozzle includes a plurality of nozzles, the liquid ejection part includes the plurality of liquid inlets, the plurality of pressure chambers that stores liquid supplied respectively through the plurality of liquid inlets, and the plurality of nozzles that ejects liquid supplied from the plurality of pressure chambers, and liquid flows in from a common opening of the intermediate supply flow path to the plurality of liquid inlets on the first opening forming surface.

In an exemplary embodiment, the liquid discharge flow path includes individual discharge flow paths branched from discharge flow paths corresponding to the plurality of respective nozzles, and one or more common discharge flow paths communicating to two or more of the individual discharge flow paths and directing liquid in the two or more individual discharge flow paths to the liquid discharge opening.

In an exemplary embodiment, the intermediate discharge flow path includes a first intermediate discharge flow path and a second intermediate discharge flow path on an opposite side of the intermediate supply flow path from the first intermediate discharge flow path in the flow path part, and the discharge liquid inlet includes discharge liquid inlets corresponding respectively to the first intermediate discharge flow path and the second discharge flow path.

In an exemplary embodiment, the flow path part is bonded to at least one of the first opening forming surface and the second opening forming surface with an adhesive agent, and a flow area limiter to limit a flowable area of the adhesive agent is disposed on a surface of the flow path part that is bonded to the first opening forming surface and/or the second opening forming surface with the adhesive agent.

The invention is the liquid ejection device including the liquid ejection head described above.

Advantageous Effects of Invention

The present invention has an effect of making it easier to manufacture a liquid ejection head.

DESCRIPTION OF EMBODIMENTS

Hereinafter, an embodiment of a liquid ejection head and a liquid ejection device according to the present invention is described with reference to the drawings.

Figure 1:
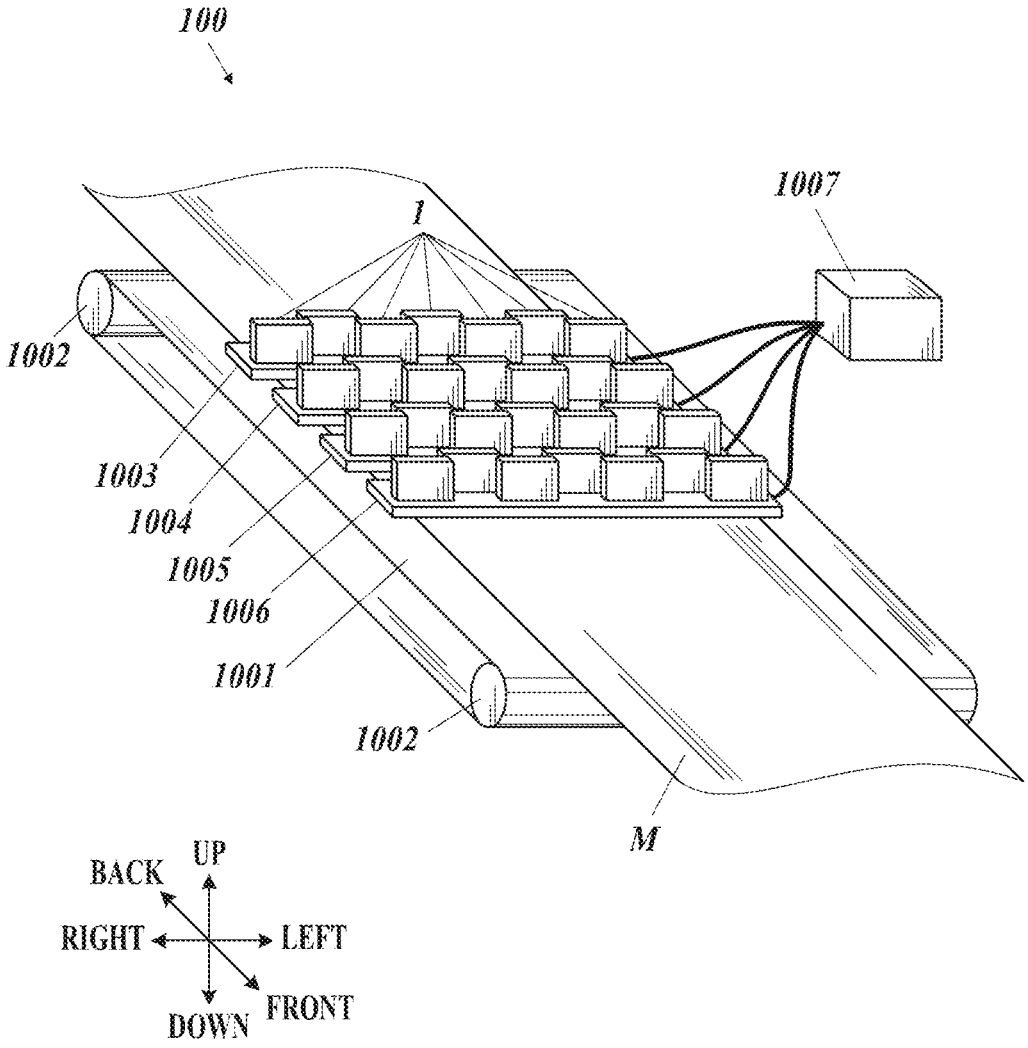
FIG. 1 shows a schematic configuration of an inkjet recording device.

FIG. 1 shows a schematic configuration of an inkjet recording device 100 (liquid ejection device) in the embodiment of the present invention.

In the descriptions given below, the direction of conveyance of a recording medium M is referred to as the front-back direction, the direction perpendicular to the said direction of conveyance on the conveyance face is referred to as the left-right direction, the direction perpendicular to the front-back direction and the left-right direction is referred to as the up-down direction.

Figure 9:
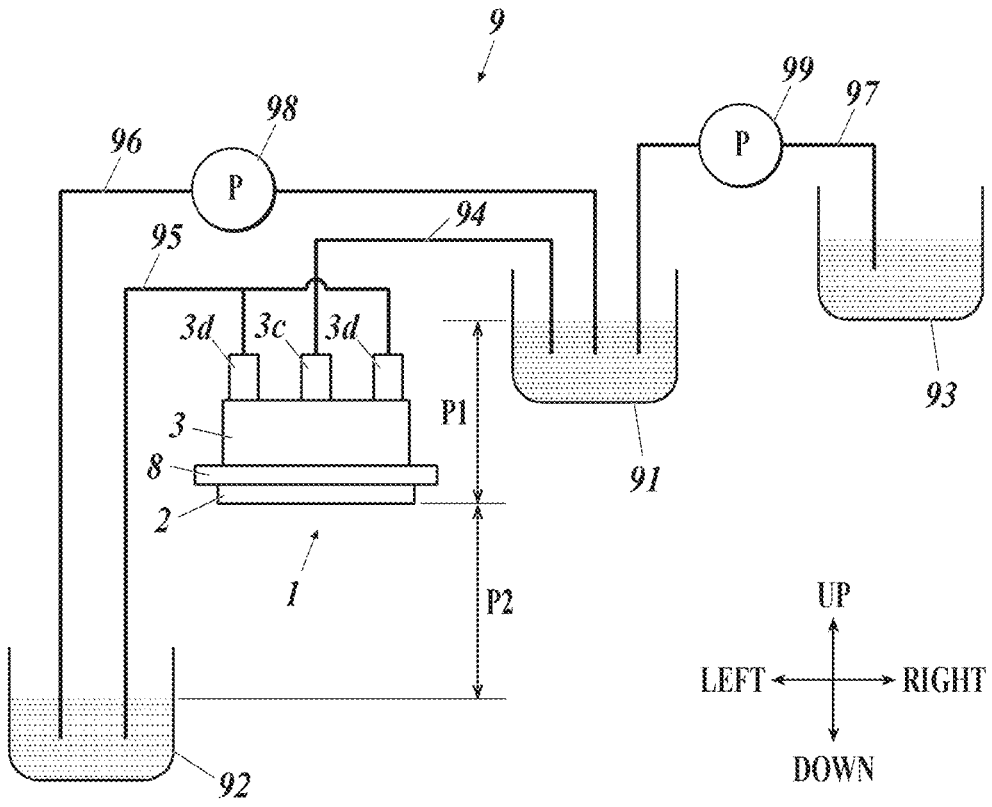
FIG. 9 is a schematic drawing showing a configuration of an ink reflow mechanism.

The inkjet recording device 100 includes a conveyance belt 1001, a conveyance roller 1002, head units 1003, 1004, 1005, 1006, a controller 1007, and an ink reflow mechanism 9 (FIG. 9). Among those, the controller 1007 includes a CPU (Central Processing Unit), a RAM (Random Access Memory), and a ROM (Read Only Memory), and reads out and executes the various kinds of control programs stored in the ROM to integrally control the operations of the inkjet recording device 100.

The conveyance roller 1002 is rotated on a rotational axis by driving of a drive motor not shown in the drawings. The conveyance belt 1001 is a ring-shaped belt supported inside by a pair of the conveyance rollers 1002 and rotary moves according to the rotation of the conveyance rollers 1002. The inkjet recording device 100 performs the conveyance operation to convey the recording medium M in the direction of movement of the conveyance belt 1001 (the front direction in the drawings) as the conveyance belt 1002 rotary moves at a speed corresponding to the rotation speed of the conveyance rollers 1002 with the recording medium M being placed on the recording medium M.

The head units 1003 to 1006 eject ink (liquid) from nozzles onto the recording medium M conveyed by the conveyance belt 1001 according to image data to record an image on the recording medium M. In the inkjet recording device 100 in the present embodiment, the four head units 1003, 1004, 1005, and 1006 respectively corresponding to yellow (Y), magenta (M), cyan (C), and black (K) are disposed in line at predetermined intervals in the written order from the upstream side in the direction of conveyance of the recording medium M.

Each of the head units 1003 to 1006 includes multiple (seven in this embodiment) recording heads 1 (liquid ejection heads) with multiple nozzles from which ink is ejected, the nozzles being aligned in the direction intersecting the direction of conveyance of the recording medium M (the width direction orthogonal to the direction of conveyance, i.e. the left-right direction, in the present embodiment). Each of the recording heads 1 includes an ink ejection face on which openings of the nozzles are disposed, and is at such a position that the said ink ejection face faces the conveyance face of the conveyance belt 1001.

The seven recording heads 1 on each of the head units 1003 to 1006 are disposed in zigzag so that the area of disposition of the nozzles in the width direction covers the width in the area of the recording medium M on the conveyance belt 1001 where an image can be recorded in the width direction. The recording heads 1 being disposed in such a way, an image can be recorded by ejection of ink from the recording heads 1 with the head units 1003 to 1006 being fixed in the inkjet recording device 100. That is, the inkjet recording device 100 records the image in a single-pass system.

Figure 2A:
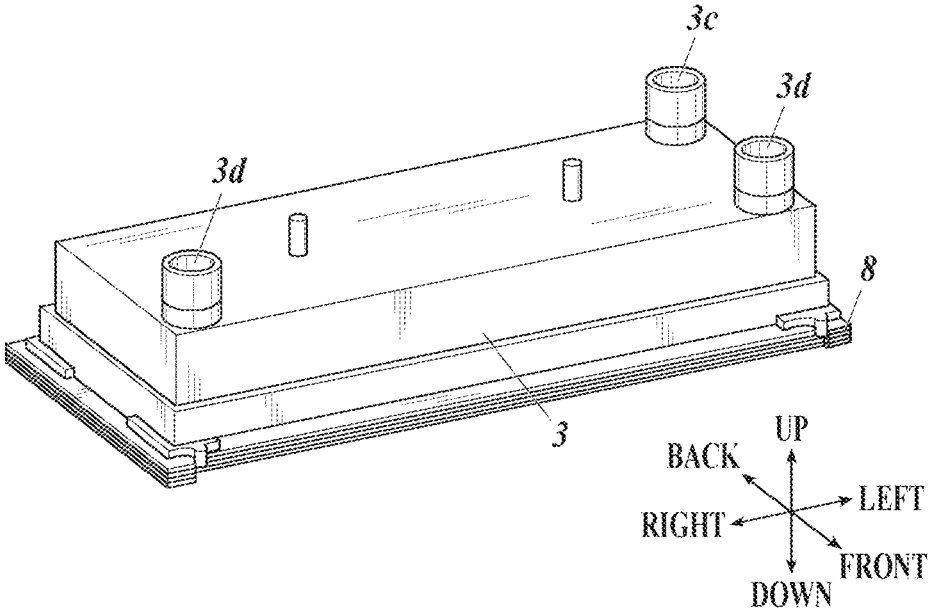
FIG. 2A is a perspective view of the upper surface of a recording head, showing a schematic configuration of main components of the recording head.
Figure 2B:
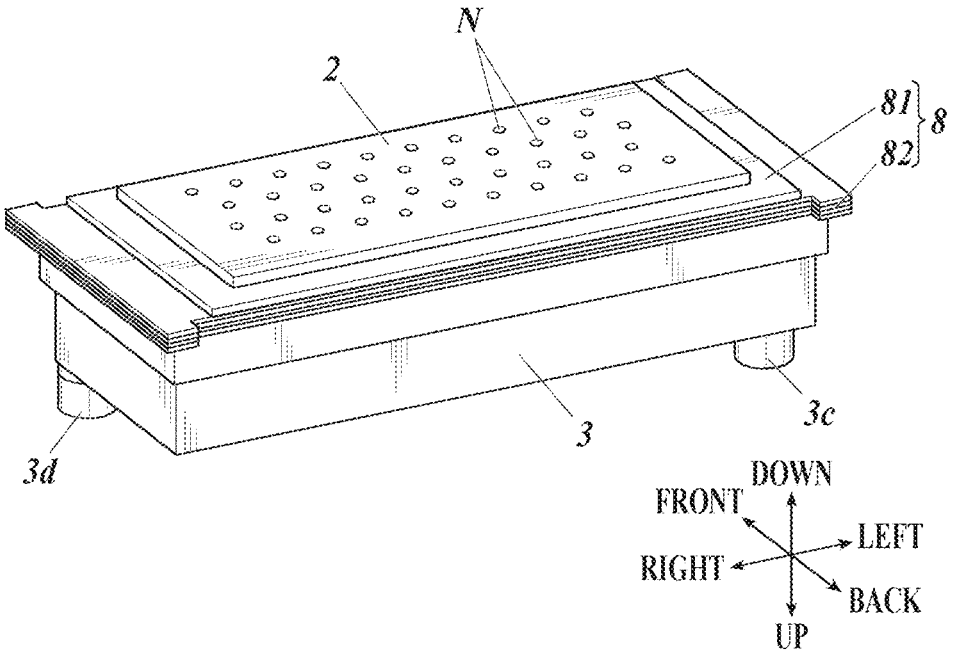
FIG. 2B is a perspective view of the lower surface of the recording head, showing a schematic configuration of main components of the recording head.

FIG. 2A and FIG. 2B are perspective views of a schematic configuration of the main components of the recording heads 1. FIG. 2A is a perspective view of the upper surface of one of the recording heads 1, and FIG. 2B is a perspective view of the lower surface of one of the recording heads 1.

Each of the recording heads 1 includes a head chip 2 (liquid ejection part) on which the nozzles N are disposed, an ink storage part 3 (liquid storage part) for storing ink supplied to the head chip 2, and a flow path part 8 disposed between the head chip 2 and the ink storage part 3.

In the head chip 2, ink supplied from a supply liquid chamber 3*a* (FIG. 6) of the ink storage part 3 through an intermediate supply flow path 8*a* (FIG. 6) in the flow path part 8 is ejected from the nozzles N. The head chip 2 also includes an ink discharge flow path (a liquid discharge flow path) for discharge (reflow) of supplied ink to the intermediate discharge flow path 8*b* (FIG. 6) in the flow path part 8, and part of supplied ink is discharged to the discharge liquid chamber 3*b* (FIG. 6) of the ink storage part 3 through the intermediate discharge flow path 8*b*.

The flow path part 8 has a structure in which a supporting plate 81 (a plate member) connected to the head chip 2 and multiple (four in this embodiment) flow path plates 82 (plate members) superimposed on the supporting plate 81 are layered. Each of the supporting plate 81 and the flow path plates 82 has a supply through hole that is part of the intermediate supply flow path 8*a* and a discharge through hole that is part of the intermediate discharge flow path 8*b*.

The ink storage part 3 includes the supply liquid chamber 3*a* (FIG. 6) for storing ink to be supplied to the head chip 2, the discharge liquid chamber 3*b* (FIG. 6) for storing ink reflowed and discharged from the head chip 2 and directed thereto, an inlet 3*c* for supplying ink from the outside to the supply liquid chamber 3*a*, and an outlet 3*d* for discharging ink from the discharge liquid chamber 3*b* to the outside. The ink storage part 3 may further include other outlets, such as one for discharging ink which has reflowed in a flow path other than the above-mentioned ink discharge flow path.

A second damper 3*g* (FIG. 7) is disposed on part of the outer peripheral wall in the front-back direction of the ink storage part 3. The second damper 3*g* is composed of elastic resin such as polyimide, metal such as stainless steel, or the like, so as to prevent the inner pressure in the ink storage part 3 from drastically increasing or decreasing.

Hereinafter, detailed configurations of the components of the recording head 1 are described.

Figure 3:
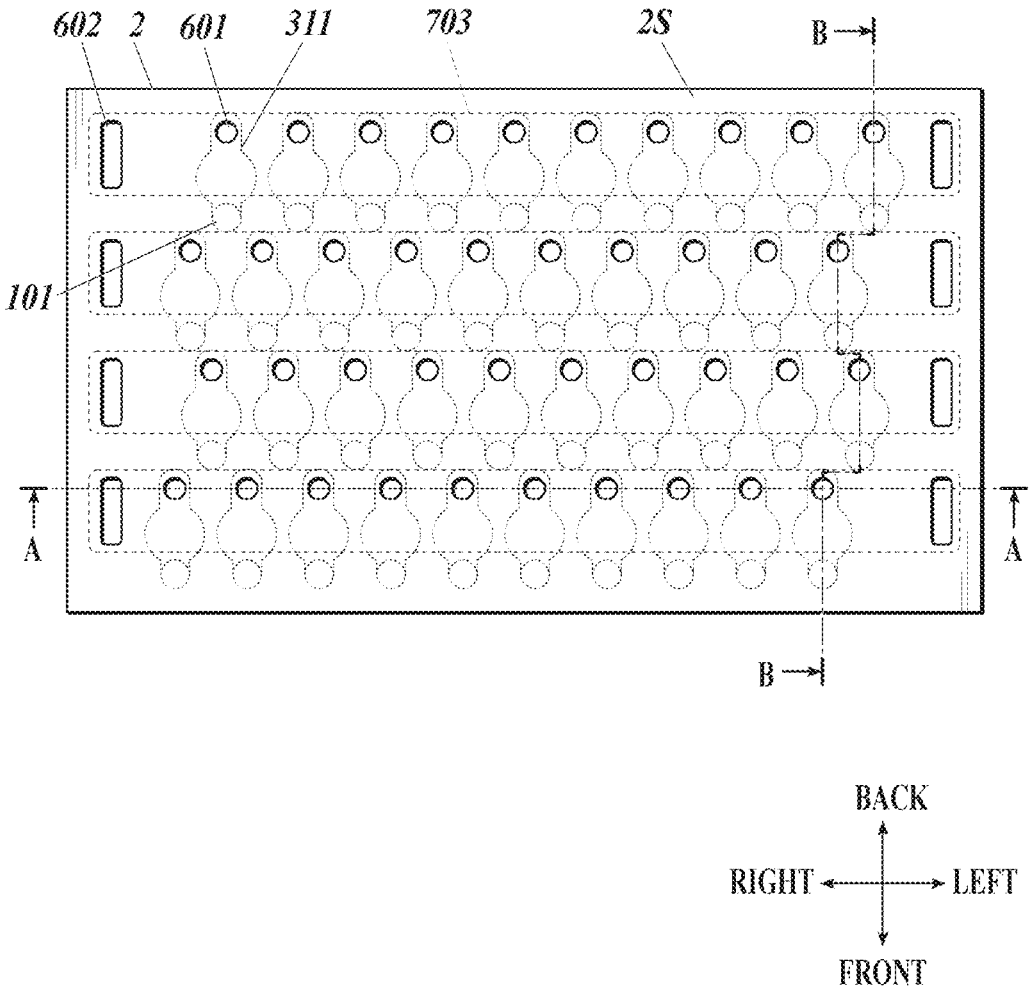
FIG. 3 is a plan view of a head chip viewed from the upper side.

FIG. 3 is a plan view of the head chip 2 viewed from the upper side. The components formed inside the head chip 2 are partly shown in a dashed line in FIG. 3.

Ink inlets 601 (liquid inlets) through which ink flows in from the intermediate supply flow path 8*a* of the flow path part 8 on the upper surface 2S of the head chip 2 are disposed respectively corresponding to the multiple nozzles N. Pressure chambers 311 in which ink flowing through the ink inlets 601 is stored and large diameter parts 101 communicating to the pressure chambers 311 are disposed inside the head chip 2, the nozzles N are formed at positions overlapping with the large diameter parts 101 in a plane view. Hereinafter, the ink flow paths from the pressure chambers 311 to the nozzles N through the large diameter parts 101 are also referred to as ejection flow paths. Accordingly, the ejection flow paths correspond to the nozzles N in number. Piezoelectric elements 42 (FIG. 7) (pressure changers) are disposed on the upper surfaces of the pressure chambers 311. When a driving signal is added to the piezoelectric elements 42 according to the control signal from the controller 1007, the pressure of ink in the pressure chambers 311 is varied with deformation of the piezoelectric elements 42 according to the said driving signal, and ink is ejected from the nozzles N communicating to the pressure chambers 311.

Individual discharge paths 102 (FIG. 8) are branched from the large diameter parts 101 in the ejection paths of the head chip 2. The individual discharge paths 102 that respectively correspond with the nozzles N in a group disposed one-dimensionally in the left-right direction communicate to the common discharge flow path 703 that extends in the left-right direction inside the head chip 2. Accordingly, the common discharge flow path 703 is formed for each of the groups (four in number in FIG. 3) of the nozzles N disposed one-dimensionally. Ink that have flowed in the common discharge flow path 703 is directed to the ink discharge opening 602 (liquid discharge opening) formed on the upper surface 2S of the head chip 2 at both ends of the common discharge flow path 703 in the left-right direction. Accordingly, the ink discharge openings 602 are disposed, four in number, at each end in the left-right direction on the upper surface 2S of the head chip 2.

As described above, the ink inlets 601 and the ink discharge openings 602 are formed on the upper surface 2S of the head chip 2, and the said upper surface 2S is also the first opening forming surface.

Figure 4:
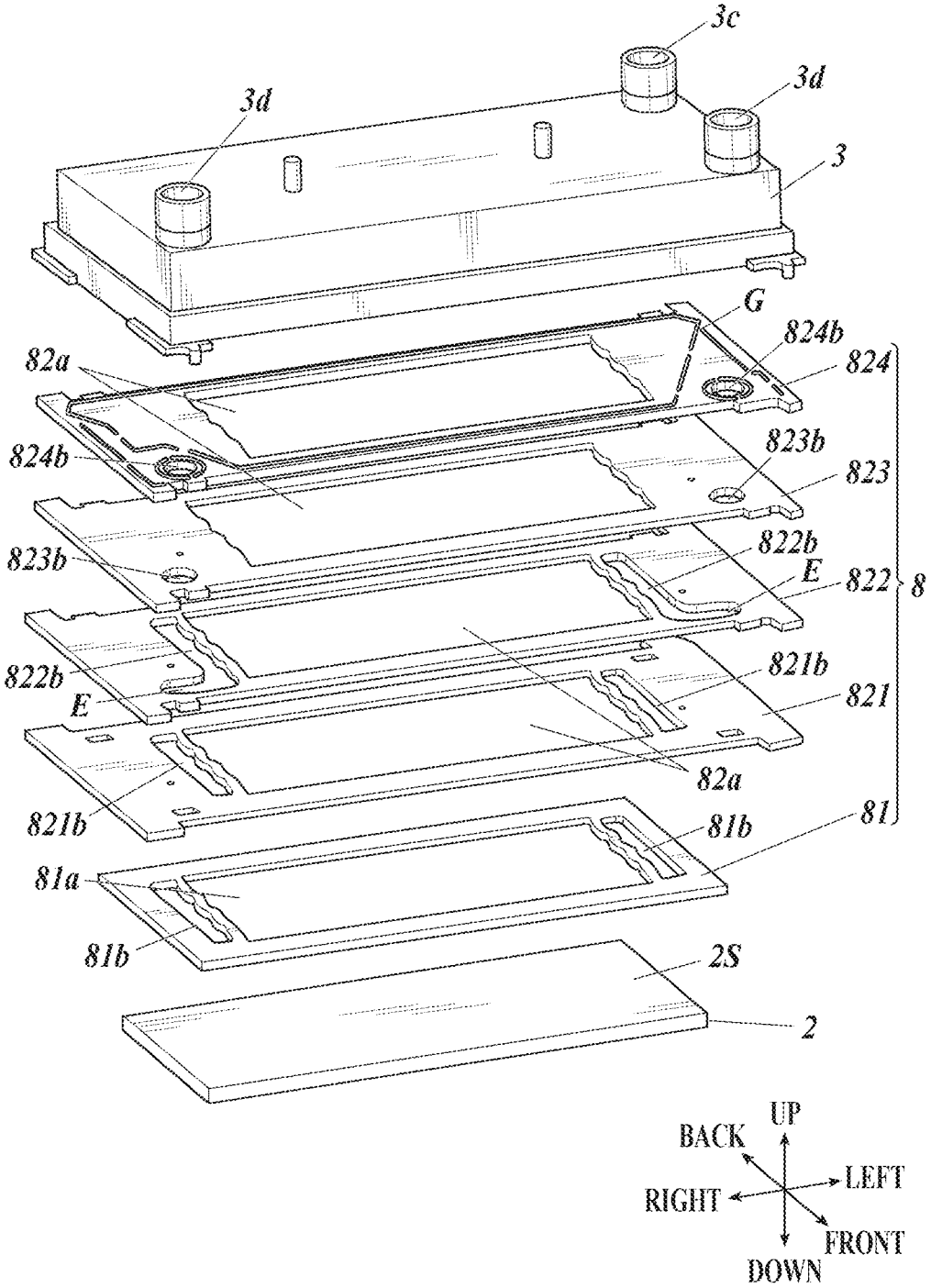
FIG. 4 is an exploded perspective view of the recording head.

FIG. 4 is an exploded perspective view of the recording head 1. Each layer of the flow path part 8 is separately shown in FIG. 4.

The supporting plate 81 of the flow path part 8 is a plate member in a rectangular shape a little larger than the head chip 2. The supporting plate 81 is bonded to the upper surface 2S of the head chip 2 with an adhesive agent.

A supply through hole 81*a* in a size encompassing all the ink inlets 601 formed on the upper surface 2S of the head chip 2 is disposed on the supporting plate 81. A discharge through hole 82*b* in a size encompassing the four ink discharge outlets 602 formed near the corners of the upper surface 2S of the head chip 2 is disposed near each end in the left-right direction of the supporting plate 81

As the distance between the ink inlets 601 and the ink discharge outlets 602 on the upper surface 2S of the head chip 2 is very small (for example, approx. 1 mm), the supporting plate 81 is bonded to the head chip 2 with precise positioning. For such precise positioning, the head chip 2 and the supporting plate 81 have each an alignment mark (not shown in the drawings).

The four flow path plates 821 to 824 are layered on the supporting plate 81. The flow path plates 821 to 824 are plate members equal to the supporting plate 81 in width in the front-back direction and are greater than the supporting plate 81 in width in the left-right direction. The lower surface of the flow path plate 821 is bonded to the upper surface of the supporting plate 81 with an adhesive agent. The flow path plates 821 to 824 are connected to each other by diffusion without using an adhesive agent. The upper surface of the flow path plate 824 is bonded to the lower surface of the ink storage part 3 with an adhesive agent.

Each of the flow path plates 821 to 824 has a supply through hole 82*a* in the same size as the supply through hole 81*a*, overlapping with the supply through hole 81*a*.

The intermediate supply flow path 8*a* is formed by the supply through hole 81*a* of the supporting board 81*a* and the supply through holes 82*a* of the flow path plates 821 to 824 in the flow path part 8.

Each of the flow path plates 821 to 824 has a discharge through hole 82*b* (821*b*, 822*b*, 823*b*, 824*b*) on both sides in the left-right direction with the supply through hole 82*a* in between.

Among those, the discharge through hole 821*b* formed in the flow path plate 821 is equal to the discharge through hole 81*b* formed in the supporting plate 81 in size and shape.

The discharge through hole 822*b* formed in the flow path plate 822 is formed with an opening in the same shape as the discharge through hole 821*b* and an extension part E extending from the front end of the said opening toward the opposite side from the supply through hole 82*a*.

The discharge through hole 823*b* formed on the flow path plate 823 is an opening in a circular shape formed at a position overlapping with the tip of the extension part E of the discharge through hole 822*b* in a plan view.

The discharge through hole 824*b* formed in the flow path plate 824 is an opening in a circular shape, encompassing the discharge through hole 823*b* with a diameter larger than that of the discharge through hole 823*b*.

The intermediate discharge flow path 8*b* is formed by the discharge through hole 81*b* of the supporting plate 81 and the discharge through holes 821*b*, 822*b*, 823*b*, 824*b* of the flow path plates 821 to 824 in the flow path part 8. A pair of the intermediate discharge flow paths 8*b* (a first intermediate discharge flow path, a second intermediate discharge flow path) are formed on the both sides across the intermediate discharge flow path 8*a*.

A material with a thermal expansion coefficient close to silicone included in the head chip 2 is preferable as the supporting plate 81, and 42 alloy is used in the present embodiment. The material of the flow path plates 821 to 824 is not particularly limited, but 42 alloy is used similarly to the supporting plate 81 in the present embodiment.

Figure 5:
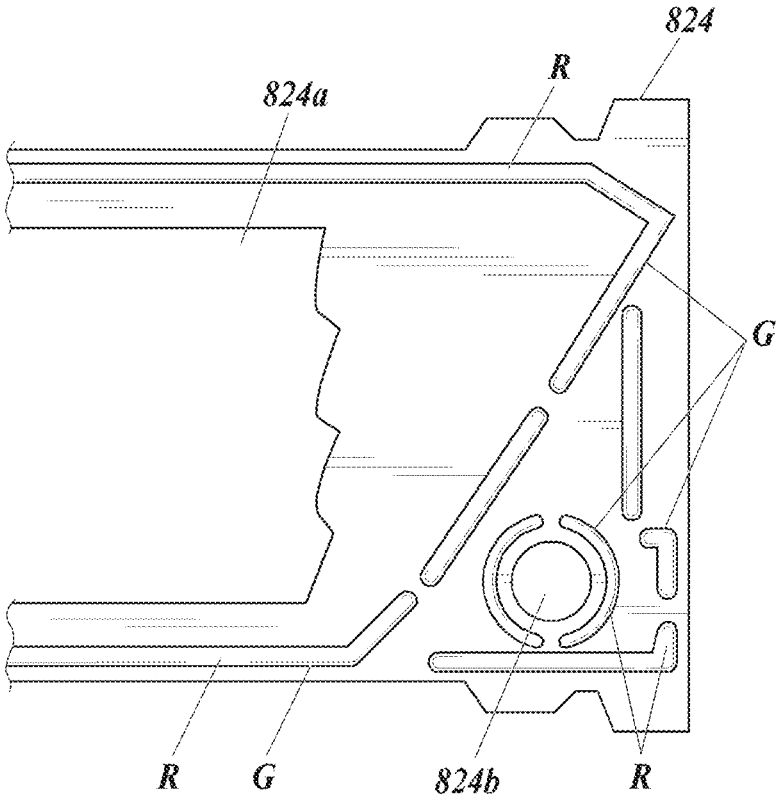
FIG. 5 shows glue guards G disposed on a flow path plate.

FIG. 5 shows glue guards G disposed on the flow path plate 824.

As shown in FIG. 5, the glue guards G (flow area limiter), which limit the flowable area of the adhesive agent to the application area R, are disposed on the upper surface of the flow path plate 824. Each of the glue guards G is a protrusion disposed on the surface of the flow path plate 824 and extends so as to surround an application area R. As an object to be connected (here, the lower surface 3S of the ink storage part 3) is connected to the area surrounded by the glue guards G, connection with the adhesive agent can be performed in the desired application area R. The application area R is preferably disposed at a position along the periphery of the flow path plate 824 and at a position around the supply through hole 824*a* and the discharge through hole 824*b*, though in any shape.

The glue guards G similar to those shown in FIG. 5 are disposed on the other surfaces which are subject to connection with an adhesive agent, i.e. the lower surface of the supporting plate 81 and the upper surface of the supporting plate 81 (or the lower surface of the flow path plate 821). The glue guards G are not necessarily disposed on all the surfaces which are subject to connection with an adhesive agent.

Figure 6:
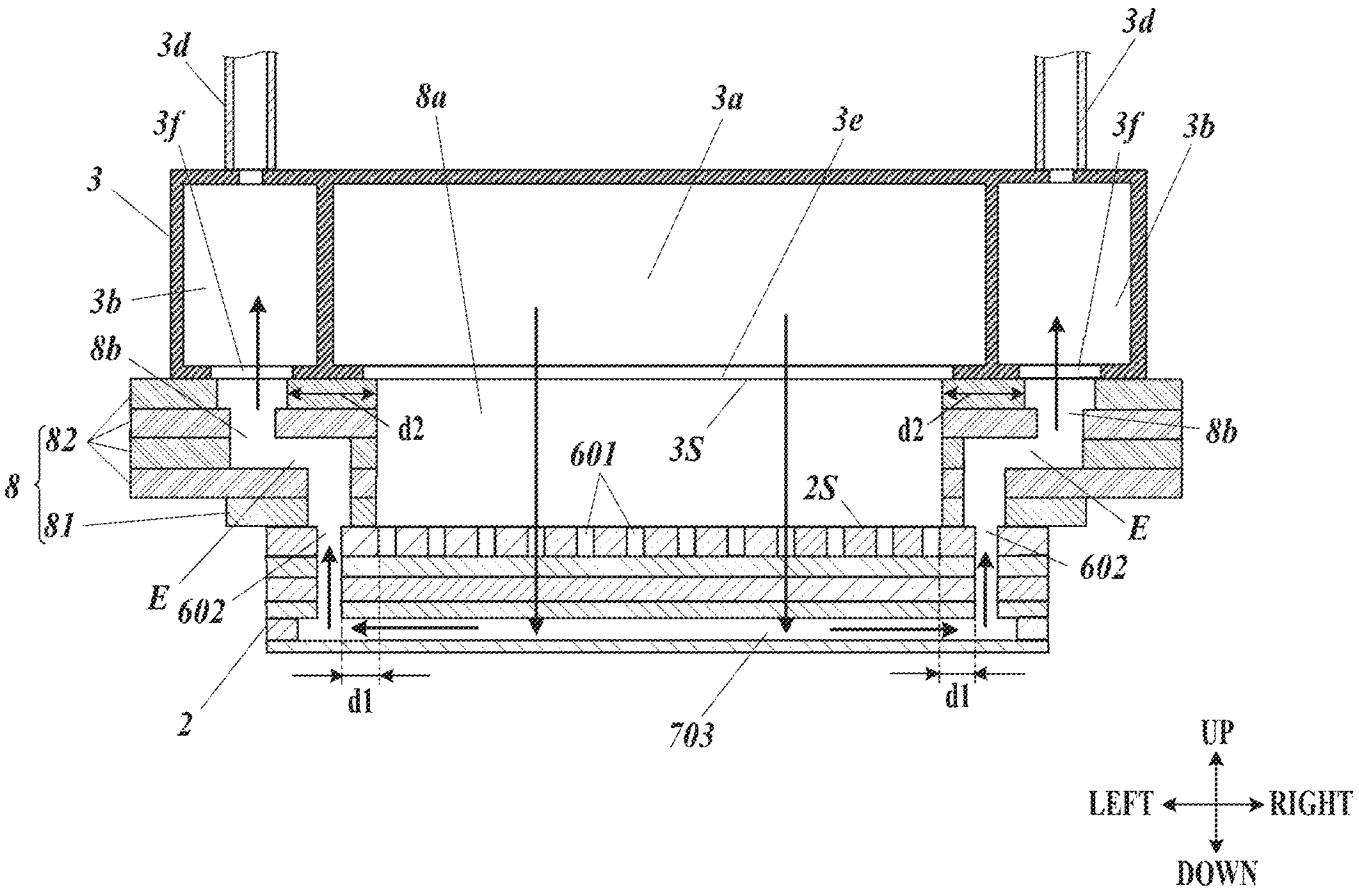
FIG. 6 is a cross-sectional view of the head chip, a flow path part, and an ink storage part taken along the line A-A in FIG. 3.

FIG. 6 is a cross-sectional view of the head chip 2, the flow path part 8, and the ink storage part 3 taken along the line A-A in FIG. 3. FIG. 6 is a schematic drawing showing the intermediate supply flow path 8*a* from the ink storage part 3 to the head chip 2, the ink discharge flow path in the head chip 2, and the intermediate discharge flow path 8*b* from the head chip 2 to the ink storage part 3, and the pressure chambers 331 communicating to the ink inlets 601, the ejection flow paths from the pressure chambers 331 to the nozzles N, and the individual discharge flow paths 102 from the ejection flow paths to the common discharge flow path 703 are omitted. The direction of ink flow is shown by an arrow in FIG. 6.

In the ink storage part 3, the supply liquid chamber 3*a* is disposed at the central part in the left-right direction, and the discharge liquid chamber 3*b* is disposed on the both sides across the supply liquid chamber 3*a*, as shown in FIG. 6. An ink supply opening 3*e* (liquid supply opening) to which ink supplied form the supply liquid chamber 3*a* flows out and a discharge liquid inlet 3*f* to which ink directed to the discharge liquid chamber 3*b* flows in are disposed on the lower surface 3S of the ink storage part 3. The lower surface 3S of the ink storage part 3 is also a second opening forming surface. The ink supply opening 3*e* is equal to the opening of the intermediate supply flow path 8*a* on the side of the ink storage part 3 in shape and size, and the discharge liquid inlet 3*f* is equal to the opening of the intermediate discharge flow path 8*b* on the side of the ink storage part 3 in shape and size.

The intermediate supply flow path 8*a* in the flow path part 8 is formed in such a shape that enables ink to be supplied through an opening of a (single) intermediate supply flow path 8*a* common to all the ink flow inlets 601 on the upper surface 2S of the head chip 2.

Part of ink supplied from the supply liquid chamber 3*a* into the head chip 2 through the intermediate supply flow path 8*a* and the ink inlets 601 is directed to the common discharge flow path 703 through the individual discharge flow path 102 as described above. In the common discharge flow path 703, ink flows leftward on the left side from the center and rightward on the right side from the center, and ink on the both sides is respectively directed to the ink discharge outlets 602 at the left and right ends on the upper surface 2S of the head chip 2.

Ink discharged through the ink discharge outlets 602 flows into the discharge liquid chambers 3*b* of the ink storage part 3 through the intermediate discharge flow path 8*b* of the flow path part 8. Here, in the intermediate discharge flow path 8*b*, as the discharge through hole 822*b* of the flow path plate 822 has the extension part E as described above, the flow path of ink bends in the direction opposite from the intermediate supply flow path 8*a*. The minimum distance (distance d2) between the opening of the intermediate supply flow path 8*a* on the surface contacting the lower surface 3S of the ink storage part 3 and the opening of the intermediate discharge flow path 8*b* in the flow path part 8 is greater than the minimum distance (distance d1) between the ink inlets 601 and the ink discharge outlets 602 on the upper surface 2S of the head chip 2. Specifically, in the present embodiment, the distance d1 is approximately 1 mm, and the distance d2 is approximately 5 mm. Especially, in the present embodiment, as the flow path plate 82 is longer than the head chip 2 in the left-right direction and the intermediate discharge flow path 8*b* bends to extend out of the range overlapping with the head chip 2 in a plan view, the above-described distance d2 can be sufficiently greater than the distance d1. The recording head 1 can be manufactured more easily with such a configuration, because the accuracy required for the connection position of the ink storage part 3 is modulated compared to the configuration in which the lower surface 3S of the ink storage part 3 is directly connected to the upper surface 2S of the head chip 2.

As the multiple flow path plates 82 are layered to form the flow path part 8, the height of the flow path at the extension part E can be limited to the thickness of one of the flow path plates 82. As the flow path at the extension part E is narrow, the flow speed of ink flowing at the extension part E increases, and air bubbles and foreign objects included in ink can be flown away easily.

The cross sectional area of the intermediate discharge flow path 8*b* increases from the flow path plate 823 to the flow path plate 824 in the flow path part 8. This is because the diameter of the discharge through hole 824*b* of the flow path plate 824 is greater than that of the discharge through hole 823*b* of the flow path plate 823 as described above. With a configuration in which the cross sectional area of the intermediate discharge flow path 8*b* increases in the direction of ink flow, air bubbles and foreign objects can be easily discharged to the ink storage part 3.

Ink flow described in FIG. 6 can be generated by the ink reflow mechanism 9. A configuration of the ink reflow mechanism 9 is described later.

Next, a configuration of the head chip 2 is described in detail.

Figure 7:
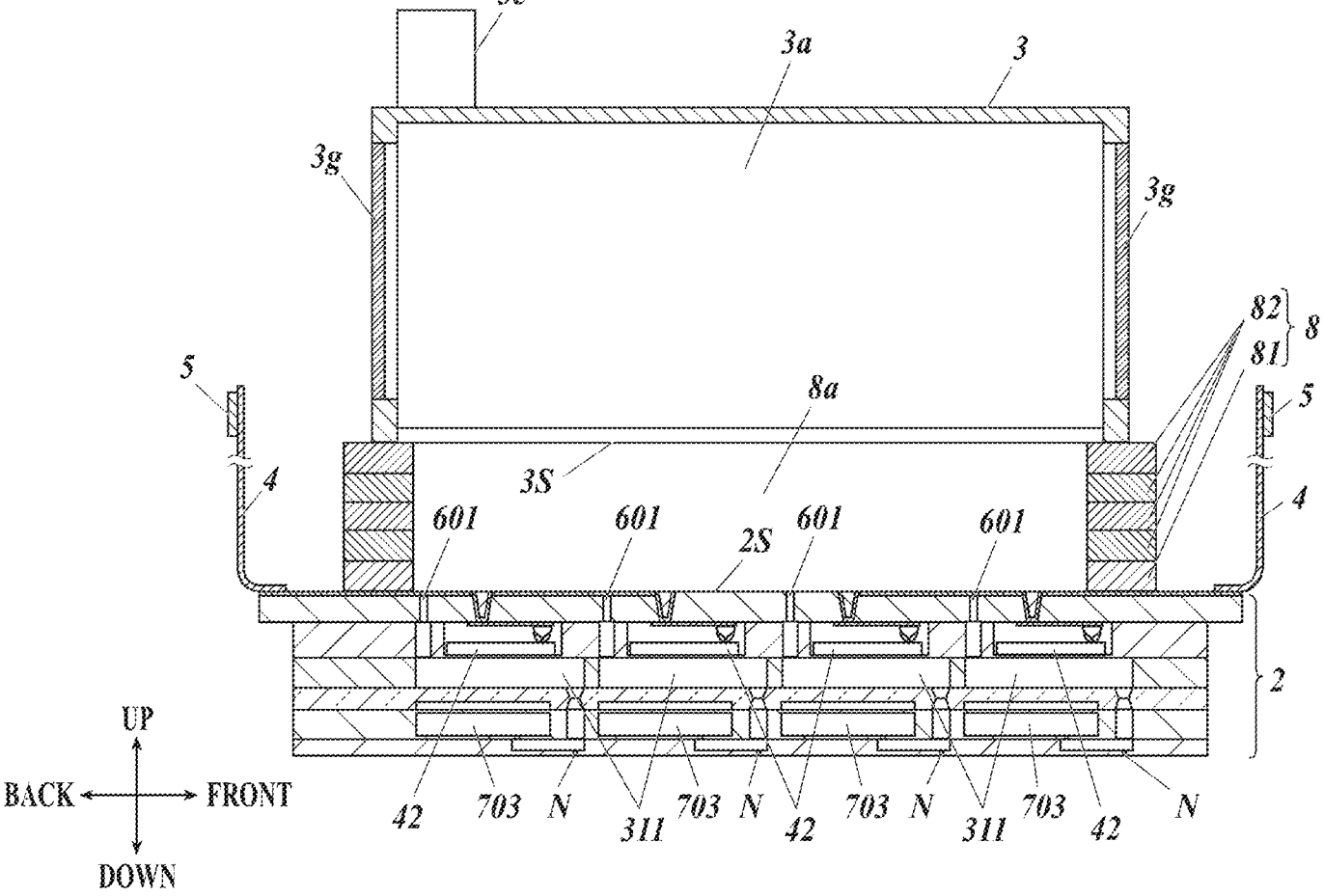
FIG. 7 is a cross-sectional view of the head chip, a flow path part, and an ink storage part taken along the line B-B in FIG. 3.

FIG. 7 is a cross-sectional view of the head chip 2, the flow path part 8, and the ink storage part 3 taken along the line B-B in FIG. 3.

Figure 8:
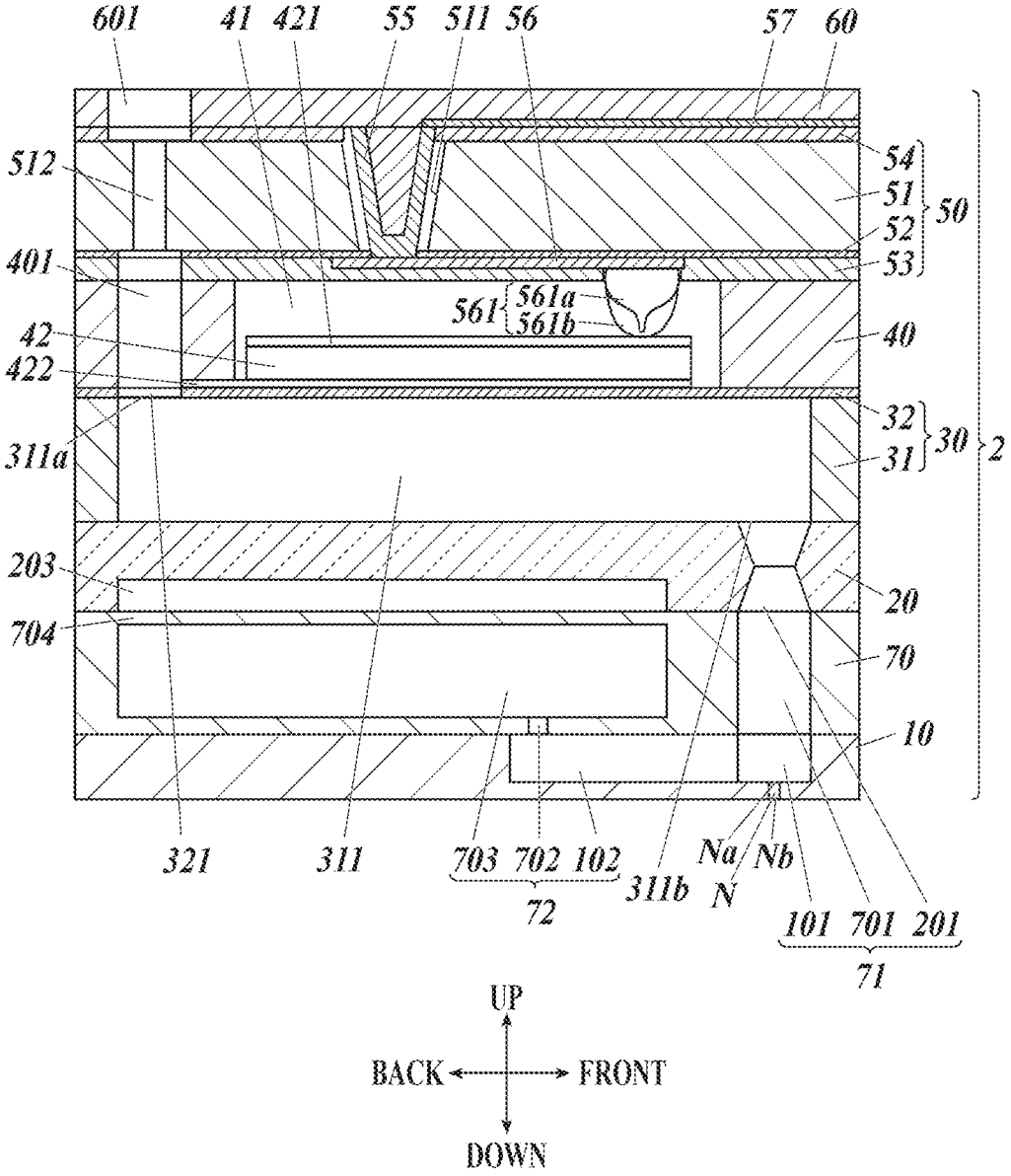
FIG. 8 is a cross-sectional view of a part of the head chip corresponding to one of nozzles.

FIG. 8 is a cross-sectional view of a part of the head chip 2 corresponding to one of the nozzles N.

The head chip 2 has a structure in which a nozzle plate 10, a common flow path plate 70, a middle plate 20, a pressure chamber plate 30, a spacer plate 40, a wiring plate 50, and a protection layer 60 are layered in the written order from the lower side.

The nozzles N, the large diameter parts 101 having a diameter greater than that of the nozzles N and respectively communicating to the nozzles N, and the individual discharge flow paths 102 disposed separately from the large diameter parts 101 and used for ink discharge are disposed on the nozzle plate 10. The nozzles N are disposed in multiple rows (for example, four rows) in the left-right direction, for example (see FIG. 3).

The nozzle plate 10 is made of a SOI plate processed by anisotropic etching with a high accuracy. Thus, the length of the nozzles N in the up-down direction and the thickness of the individual discharge flow paths 102 at the lower part can be as narrow as 10 μm, for example. As the individual discharge flow paths 102 are branched in the large diameter parts 101 at the upper part of the nozzles N, ink near the nozzles N can reflow and be discharged, air bubbles near the nozzles N can be flown to the individual discharge flow paths 102.

The common flow path plate 70 is a plate made of silicone, and includes large diameter parts 701, narrow parts 702, and the common discharge flow paths 703.

Each of the large diameter parts 701 penetrates the common flow path plate 70 in the up-down direction, and has a diameter greater than that of the large diameter parts 101 of the nozzle plate 10, communicating to each other.

Ink flowing from the multiple individual discharge flow paths 102 flows into the common discharge flow path 703 that each communicate to one row of the individual discharge flow paths 102 aligned in the direction of disposition of the nozzles N (the left-right direction) through the narrow parts. The common discharge flow paths 703 are disposed in the direction of disposition of the nozzles N (the left-right direction), have a flow path penetrating from the common flow path plate 70 to the protection layer 60 near the right and left ends of the head chip 2 and extending upward, and communicate to the ink discharge outlets 602 on the upper surface 2S of the head chip 2 (see FIG. 6). In the descriptions given below, the individual discharge flow path 102, the narrow part 702, and the common discharge flow paths 703 are called the discharge flow paths 72 as a whole. As long as the flow path impedance of the individual discharge flow paths 102 can be sufficiently large, the narrow parts 702 can be omitted.

A first damper 704 is disposed on the common flow path plate 70. The first damper 704 is, for example, made of silicone, metal, or resin which is elastically deformable, and may have a structure in which multiple layers are stacked by bonding.

The first damper 704 is made of a Si plate with a thickness of 1 to 50 μm, for example, and disposed facing the upper surface of the common discharge flow path 703. An air chamber 203 is formed on the upper surface of the first damper 704. Being a thin Si plate, the first damper 704 can be elastically deformed by difference in pressure between the common discharge flow path 703 and the air chamber 203 so as to change the volume of the common discharge flow path 703. This can prevent abrupt change in pressure in the ink flow path. As the air chamber 203 is closed, damping force is caused in a case where the first damper 704 vibrates with deformation, further preventing change in pressure.

Each of the common discharge flow paths 703 communicates to a row of the individual discharge flow paths 102 aligned in the direction of disposition of the nozzles N (the left-right direction) in the description given above, but it may communicate to two or more rows of the individual discharge flow paths 102. Accordingly, there may be a single common discharge flow path 703 that communicates to the individual discharge flow paths 102 corresponding to all the nozzles N.

The middle plate 20 is a plate made of glass, and a communicating hole 201 penetrating in the up-down direction, and a space part that serves as an air chamber 203 dented upward on the upper surface of the first damper 704 are formed on the middle plate 20.

The communicating hole 201 communicates to the large diameter part 701. The communicating hole 201 is in such a shape that narrows the diameter of the path through which ink passes, and is formed to adjust the kinetic energy applied to ink in ink ejection. In the descriptions given below, the communicating hole 201, the large diameter part 701, and the large diameter part 101 are referred to as the communicating path 71 in all.

The pressure chamber plate 30 is constituted of a pressure chamber layer 31 and a vibration plate 32. The pressure chamber 31 is a plate made of silicone, and the pressure chambers 311 for storing ink ejected from the nozzles N in the pressure chamber layer 31. The pressure chambers 311 are disposed in the left-right direction in multiple rows (for example, four rows) corresponding to the nozzle rows (see FIG. 3). The pressure chambers 311 communicate to the communicating path 71 which serves as a flow path in ink ejection at the lower part of the front end (the outlet 311*b* of the pressure chamber). The pressure chambers 311 penetrate the pressure chamber layer 31 in the up-down direction to extend in the front-back direction.

The vibration plate 32 is layered on the upper surface of the pressure chamber layer 31 to cover the opening of the pressure chamber 311 and serves as the upper wall of the pressure chamber 311. An oxide film is formed on the upper surface of the vibration plate 32. A through hole 321 communicating to the pressure chamber 311 to penetrate upward is disposed on the vibration plate 32.

The spacer base 40 is a plate composed of 42 alloy and is a partition layer that forms the space 41 for storing a piezoelectric element 42, etc. between the vibration plate 32 and the wiring plate 50.

The piezoelectric element 42 is formed in a shape similar to the pressure chamber 311 in a plan view at a position facing the pressure chamber 311 across the vibration plate 32. The piezoelectric element 42 is an actuator made of PZT (lead zirconate titanate) to deform the vibration plate 32. Two electrodes 421, 422 are disposed on the upper and lower sides of the piezoelectric element 42, and the electrode 422 on the lower side is connected to the vibration plate 32.

A through hole 401 communicating to the through hole 321 of the vibration plate 32 to penetrate upward is disposed on the spacer plate 40, independent of the space 41.

The wiring plate 50 has an interposer 51 that is a plate made of silicone. Two layers of silicon oxide as insulation layers 52, 53 cover the lower surface of the interposer 51, and an insulation layer 54 of silicon oxide covers the upper surface. The insulation layer 53 that is the lower one of the insulation layers 52, 53 is layered on the upper surface of the spacer plate 40.

A through hole 511 penetrating upward is disposed on the interposer 51, and a penetrating electrode 55 is inserted to the through hole 511. One end of the wire 56 extending in the horizontal direction is connected to the lower end of the penetrating electrode 55.

The other end of the said wire 56 is connected to the electrode 421 on the upper surface of the piezoelectric elements 42 via the connection unit 561. The connection unit 561 is constituted with a stud bump 561*a* and a conductive material 561*b* coated on the lower end side of the stud bump 561*a*. The stud bump 561*a* is formed by wire bonding with gold as a material, for example. A conductive adhesive agent or solder may be used as the conductive material 561*b*.

An individual wire 57 is connected to the upper end of the penetrating electrode 55, and extends in the horizontal direction and is connected to a connection member 4 (FIG. 7). The connection member 4 is a wiring member of an FPC, for example, connected to the driving circuit 5. A driving signal is supplied from the driving circuit 5 to the piezoelectric element 42 via the connection member 4 and the individual wire 57.

A through hole 512 communicating to the through hole 401 of the spacer plate 40 to penetrate upward is formed on the interposer 51. Each part of the insulation layers 52 to 54 covering the part around the through hole 512 is formed to have an opening with a diameter larger than the through hole 512.

The protection layer 60 is a photosensitive resin layer attached to the supporting plate 81 as well as a layer to protect the individual wire 57, and covers the individual wire 57 that is disposed on the upper surface of the wiring plate 50, while being layered on the upper surface of the insulation layer 54 of the interposer 51. The ink inlets 601 communicating to the through holes 512 are formed on the protection layer 60.

Next, the discharge path of ink inside the head chip 2. Ink is supplied from the supply liquid chamber 3*a* of the ink storage part 3 to the inside of the head chip 2 through the ink inlets 601 disposed respectively corresponding to the nozzles N. Then, ink flows through the through holes 512, 401, and the pressure chamber 311, in the written order. In ink ejection, ink flows through the communicating path 71 (the communicating hole 201, the large diameter part 701, and the large diameter part 101) and the nozzle N in the written order to be ejected to the outside. Part of ink flowing to the large diameter part 101 flows to the individual discharge flow paths 102 branched at the large diameter part 101 and then to the common discharge flow path 703. Then, in the common discharge flow path 703, ink flows toward the end of the head chip 2 in the left or right direction, and is discharged through ink discharge outlet 602 disposed on the upper surface 2S of the head chip 2 to the discharge liquid chamber 3*b* of the ink storage part 3 through the intermediate discharge flow path 8*b*.

Each of the individual discharge flow paths 102 is branched from the communicating path 71 communicating to the nozzle N and the pressure chamber 311, for example, in the descriptions given above, but it is just to be branched from the ink flow path from an ink inlet 311*a* of the pressure chamber 311 to an outlet Nb of the nozzle N. Here, each of the individual discharge flow paths 102 is preferably branched from the part from the end of the pressure chamber 311 on the side of the outlet 311*b* to the outlet Nb (opening) of the nozzle N. The inlet 311*a* (ink inlet) and the outlet 311*b* (ink outlet communicating to the aperture Na of the nozzle N) of the pressure chamber 311, the inlet Na (ink inlet) of the nozzle N, and the outlet Nb (ink outlet) of the nozzle N are shown in FIG. 8.

In a case where the discharge flow path 72 is branched from the nozzle N, the discharge flow path 72 is preferably constituted as follows: a groove as the discharge flow path 72 that is disposed corresponding to the nozzles N is formed on the side of the pressure chamber 311 of a nozzle forming plate on which the nozzle N is formed as a through hole; and the said nozzle forming plate and the flow path forming plate on which the flow path communicating to the nozzle N are connected.

Here, the common discharge flow paths 703 and the narrow parts may be formed on the nozzle forming plate or on the flow path forming plate.

For example, in a case where they are formed on the flow path plate, the discharge flow path 72 is preferably constituted as follows: a groove (the individual discharge flow path 102) that reaches the narrow part of the flow path forming plate or the common discharge flow path 703 is formed corresponding to each of the nozzles N on the side adjacent to the flow path forming plate of the nozzle forming plate; and the nozzle forming plate is connected to the flow path plate on which the narrow part or the common discharge flow path 703 is formed.

For example, in the embodiment of FIG. 8, the individual discharge flow path 102 branched from the nozzle N, the narrow part 702, and the common discharge flow path 703 can be formed as follows: the nozzle N as a penetrating hole is formed on the nozzle plate 10 to be the nozzle forming plate; a groove, as the individual discharge flow path 102, that is formed communicating to the nozzle N on the side of the common flow path plate 70 of the nozzle forming plate to reach the narrow part 702 adjacent to the other side; and the nozzle forming plate is connected to the common flow path plate 70 (flow path plate).

In a case where the discharge flow path 72 is branched from the nozzle N, the nozzle N preferably tapers, that is, the hole diameter thereof diminishes gradually from the side of the aperture Na of the nozzle N.

In a case where the discharge flow path 72 is branched from the end of the pressure chamber 311 on the side of the outlet 311*b*, the discharge flow path 72 is preferably constituted as follows: a groove, as the discharge flow path 72, is formed corresponding to each of the pressure chambers 311 on the side of the nozzles N of the pressure chamber plate 30 on which the pressure chambers 311 are formed; and the pressure chamber plate is connected to the flow path forming plate on which the flow path communicating to the pressure chamber 311 is formed.

The common discharge flow path 703 and the narrow part may be formed on the pressure chamber plate 30 or on the flow path forming plate.

In a case where they are formed on the flow path forming plate, a groove (the individual discharge flow path 102) to reach the narrow part of the flow path forming plate or the common discharge flow path 703 is formed corresponding to each of the pressure chambers 311 on the side adjacent to the flow path forming plate of the pressure chamber plate 30, and that the pressure chamber plate 30 is connected to the flow path plate on which the narrow part or the common discharge flow path 703 is formed.

For example, in the embodiment of FIG. 8, the individual discharge flow path 102 of the nozzle plate 10 is omitted, a Si plate is used as the middle plate 20, the common discharge flow path 703, and the narrow part 702 are disposed such that the positions of the narrow part 702 and the first damper 704 in the up-down direction are switched so that the narrow part 702 is at the upper part and at the back end of the common discharge flow path 703, and the air chamber 203 is disposed at the upper part of the common flow path plate 70.

The common discharge flow path 703, the narrow part 702, and the first damper 704 are disposed at positions shifted backward in FIG. 8 such that the narrow part 702 is disposed at a position shifted backward in FIG. 8 not to overlap with the pressure chamber 311 in the up-down direction. The individual discharge flow path 102, the narrow part 702, and the common discharge path 703 are formed as follows: a groove, as the individual ejection flow path 102, that is disposed communicating to the pressure chamber 311 of the pressure chamber plate 30 forming the pressure chamber 311 on the side of the middle plate 20 to reach the narrow part 702 adjacent to the other side; and the said pressure chamber plate 30 is connected to the middle plate 20 (flow path forming plate). In a case where the narrow part 702 is not disposed, the narrow part 702 may be the common discharge flow path 703, for example.

Next, a configuration of the ink reflow mechanism 9 for reflowing and discharging ink in the recording head 1 is described.

FIG. 9 is a schematic drawing showing the configuration of the ink reflow mechanism 9.

The ink reflow mechanism 9 includes a supply sub tank 91, a sub tank for reflow 92, and a main tank 93.

The supply sub tank 91 is filled with ink to be supplied to the supply liquid chamber 3*a* of the ink storage part 3, and is connected to the inlet 3*c* by the ink flow path 94.

The sub tank for reflow 92 is filled with ink discharged from the liquid discharge chamber 3*b* of the ink storage part 3, and is connected to the outlet 3*d* by the ink flow path 95.

The supply sub tank 91 and the sub tank for reflow 92 are disposed at different positions when viewed from the ink ejection surface (hereinafter also referred to as a positional reference surface) of the head chip 2 in the up-down direction (the gravitational direction). Thus, a pressure P1 is generated by the water head difference between the positional reference surface and the sub tank for supply 91 and a pressure P2 is generated by the water head difference between the positional reference surface and the sub tank for reflow 92.

The sub tank for supply 91 and the sub tank for reflow 92 are connected by the flow path 96. The pressure applied to the pump 98 can return ink from the sub tank for reflow 92 to the sub tank for supply 91.

The main tank 93 is filled with ink to be supplied to the sub tank for supply 91, and is connected to the sub tank 91 by the ink flow path 97. Ink can be supplied from the main tank 93 to the sub tank for supply 91 by the pressure applied by the pump 99.

The pressure P1 and the pressure P2 can be adjusted by the adjustment of the ink amount in each sub tank and the position change of each sub tank in the up-down direction (the gravitational direction) as described above. Ink can reflow in the flow path from the supply liquid chamber 3*a* of the ink storage part 3 to the discharge liquid chamber 3*b* of the ink storage part 3 through the common discharge flow path 703 in the head chip 2 at an appropriate reflow speed by the pressure gap between the pressure P1 and the pressure P2. In that way, air bubbles and foreign objects contained in ink in the head chip 2 can be removed, and clogging of the nozzles N and ejection failure can be suppressed.

As described above, the recording head 1 of the present embodiment includes: the head chip 2 including: the pressure chamber 311 that stores ink supplied from the ink inlet 601 formed on the upper surface 2S as the first opening forming surface; the nozzle N that ejects ink supplied from the pressure chamber 311 according to change in pressure of ink in the pressure chamber 311; and the ink discharge flow path (the individual discharge flow path 102 and the common discharge flow path 703) that is branched from the ejection flow path between the inlet of ink of the pressure chamber 311 and the opening of the nozzle N and that directs ink supplied to the pressure chamber 311 to the ink discharge outlet 602 formed on the upper surface 2S;

the ink storage part 3 including: the supply liquid chamber 3*a* that stores ink to be supplied to the pressure chamber 311 through the ink inlet 601; and the discharge liquid chamber 3*b* to which ink is directed from the ink discharge outlet 602, wherein the ink storage part 3 has the ink supply opening 3*e* through which ink flows out of the supply liquid chamber 3*a* and the discharge ink inlet 3*f* through which ink flows in to the discharge liquid chamber 3*b*, wherein the ink supply opening 3*e* and the discharge inlet 3*f* are formed on the lower surface 3S; and the flow path part that is disposed between the upper surface 2S of the head chip 2 and the lower surface 3S of the ink storage part 3 and that includes the intermediate supply flow path 8*a* to direct ink from the ink supply opening 3*e* to the ink inlet 601 and the intermediate discharge flow path 8*a* to direct ink from the ink discharge outlet 602 to the discharge liquid inlet 3*f*;

wherein the intermediate supply flow path 8*a* and the intermediate discharge flow path 8*b* are formed such that the minimum distance (distance d2) between the opening of the intermediate supply flow path 8*a* on the side facing the ink storage part 3 and the opening of the intermediate discharge flow path 8*b* on the side facing the ink storage part 3 is greater than the minimum distance (distance d1) between the ink inlet 601 and the ink discharge outlet 602 on the first opening forming surface.

With such a configuration, the ink storage part 3 is connected to the flow path part 8 in which the opening of the intermediate supply flow path 8*a* and the opening of the intermediate discharge flow path 8*b* are separate by a distance greater than the distance d2. Thus, the required accuracy of connection position of the ink storage part 3 can be modulated compared to a case with a configuration in which the ink storage part 3 is directly connected to the upper surface 2S of the head chip 2. When the ink storage part 3 is connected to the flow path part 8, it is possible to suppress easily a failure of mixture of supplied ink and discharged ink caused as the intermediate supply flow path 8*a* and the discharge liquid chamber 3*b* communicate to each other, or the intermediate discharge flow path 8*b* and the supply liquid chamber 3*a* communicate to each other.

The flow path part 8 includes the supporting plate 81 and the multiple flow path plates 82 that are layered, and the supporting plate 81 and the multiple flow path plates 82 respectively include the supply through holes 81*a* and 82*a*, and the discharge through holes 81*b* and 82*b* that are part of the intermediate supply flow path 8*a*. With such a configuration, the intermediate supply flow path 8*a* and the intermediate discharge flow path 8*b* can be formed in such a shape that an interval between the openings of the intermediate supply flow path 8*a* and the intermediate discharge flow path 8*b* on the side of the ink storage part 3 is wider, by simple means of adjusting the positions where the supply through hole 81*a* and the discharge through hole 81*b* on the supporting plate 81 are formed or the positions where the supply through hole 82*a* and the discharge through hole 82*b* on the flow path plate 82. The height of the extension part E extending in the direction parallel to the plate surface of the flow path plate 82 in the intermediate discharge flow path 8*b* can be easily adjusted by adjustment of the thickness of the supporting plate 81 or the flow path plate 82. As the height of the extension part E is made smaller to narrow the flow path, the flow speed of ink passing through the extension part E is increased so that air bubbles and foreign objects contained in ink can be flown away.

The area of the discharge through hole 824*b* on the flow path plate 824 of the multiple flow path plates 82 is greater than the area of the discharge through hole 823*b* on the flow path plate 823 next to the said flow path plate 824 on the side of the head chip 2. As described above, with a configuration in which the cross-sectional area of the intermediate discharge flow path 8*b* increases in the direction of ink flow in at least part of the intermediate discharge flow path 8*b*, air bubbles and foreign objects contained in ink can be discharged more easily to the ink storage part 3.

The head chip 2 includes the multiple ink inlets 601, the multiple pressure chambers 311 for storing ink supplied through the respective multiple ink inlets 601, and the multiple nozzles from which ink supplied from the respective multiple pressure chambers 311 is discharged, and ink is flown in through the opening of the common intermediate supply flow path 8*a* to the multiple ink flow inlets 601 described above on the upper surface 2S of the head chip 2. In a case where the multiple ink inlets 601 are disposed on the upper surface 2S of the head chip 2 as described above, the minimum distance (the distance d1) between the ink inlets 601 and the ink discharge outlets 602 is likely to be small. Thus, though it is hard to directly connect the ink storage part 3 onto the upper surface 2S of the head chip 2, the head chip 2 and the ink storage part 3 are connected to each other with the flow path part 8 so that the recording medium 1 can be easily manufactured while suppressing mixture of supplied ink and discharged ink.

The ink discharge flow path includes the individual discharge flow paths 102 branched from the ejection flow paths respectively corresponding to the multiple nozzles N, and the common discharge flow path 703 communicating to two or more of the individual discharge flow paths 102 and directing ink in the said two or more of the individual discharge flow paths 102 to the ink discharge outlets 602. With a configuration in which ink is discharged through the common discharge flow path 703, ink can be correctly discharged with a simple configuration, and air bubbles and foreign objects can be removed in the head chip 2 with the multiple nozzles N.

The first intermediate discharge flow path 8*b* and the second discharge flow path 8*b* that is disposed on the opposite side of the first intermediate discharge flow path 8*b* across the intermediate supply flow path 8*a* are disposed in the flow path part 8, and a pair of the discharge inlets 3*f* respectively corresponding to the pair of the intermediate discharge flow paths 8*b* are disposed on the lower surface of the ink storage part 3. With such a configuration, the minimum distance (the distance d1) between the ink inlets 601 and the ink discharge outlets 602 is likely to be small. Thus, though it is hard to directly connect the ink storage part 3 is connected onto the upper surface 2S of the head chip 2 at in an appropriate positional relation, the head chip 2 and the ink storage part 3 are connected to each other with the flow path part 8 so that the recording medium 1 can be easily manufactured while suppressing mixture of supplied ink and discharged ink.

The flow path part 8 and the upper surface 2S of the head chip 2 or/and the flow path part 8 and the lower surface 3S of the ink storage part 3 is/are connected with an adhesive, and the glue guard G is disposed on the surface(s) connected to the upper surface 2S or/and the lower surface 3S with an adhesive agent. This can suppress malfunctioning that the adhesive agent flows into the intermediate supply flow path 8*a* and the intermediate discharge flow path 8*b*, and correct connection can be achieved in a desired area.

The inkjet recording device 100 in the present invention includes the above-described recording head 1. In such an inkjet recording device, the recording head 1 can be easily manufactured, and the manufacturing process of the inkjet recording device 100 can be simplified.

The present invention is not limited to the above-described embodiment, and various modifications can be made thereto.

Figure 10:
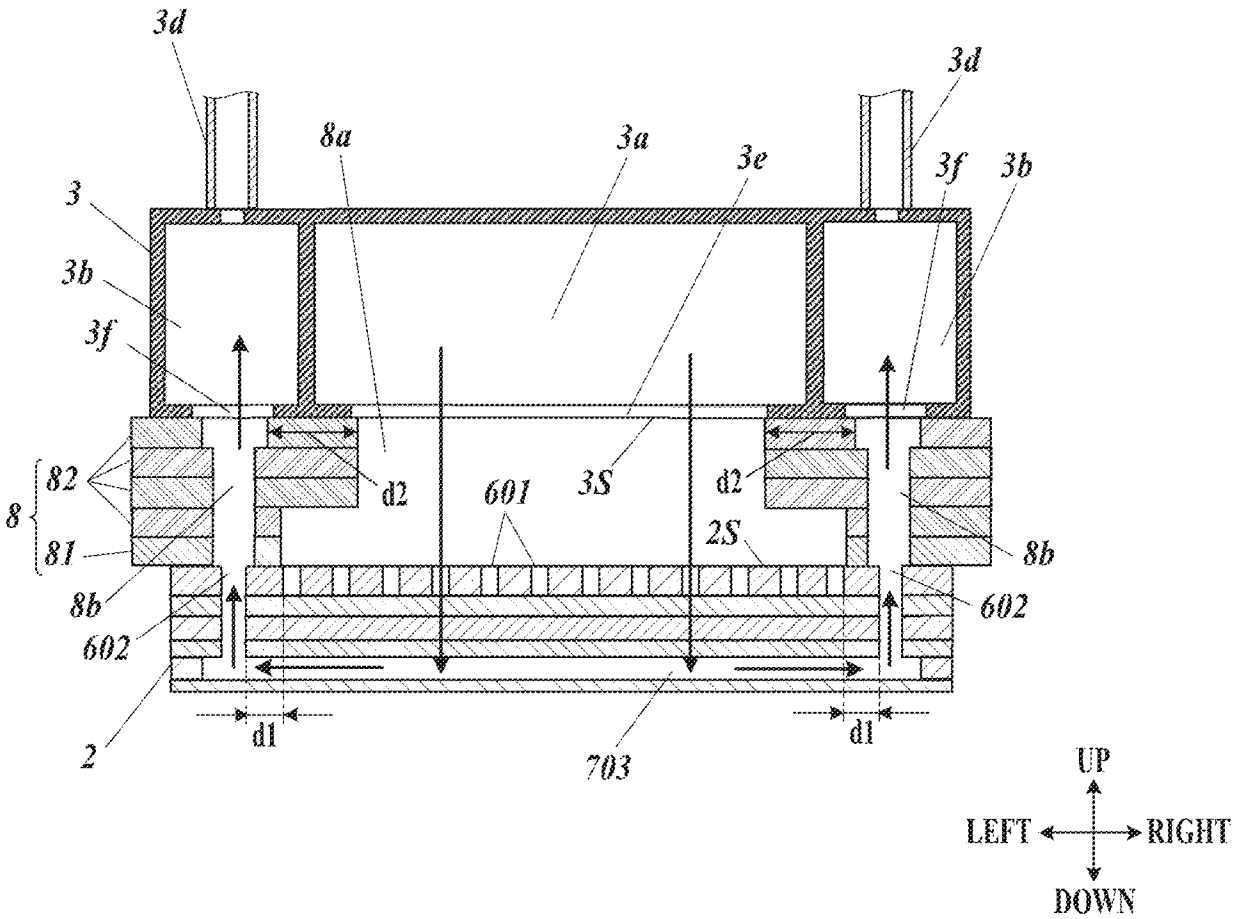
FIG. 10 is a cross-sectional view of another exemplary configuration of the flow path part.

For example, in the above-described embodiment, the intermediate discharge flow path 8*b* is bended in the flow path part 8 so that the interval between the opening of the intermediate supply flow path 8*a* and the opening of the intermediate discharge flow path 8*b* on the surface connected to the ink storage part 3, though not limited thereto. For example, the width of the intermediate supply flow path 8*a* in the left-right direction may be increased in the direction of ink flow in the intermediate supply flow path 8*a*, as shown in FIG. 10, so that the interval between the opening of the intermediate supply flow path 8*a* and the opening of the intermediate discharge flow path 8*b* on the side of the ink storage part 3 is kept wide.

The shapes of both the intermediate supply flow path 8*a* and the intermediate discharge flow path 8*b* can be adjusted. For example, in a configuration shown in FIG. 10, the intermediate discharge flow path 8*b* may be disposed such that the position of the opening of the intermediate discharge flow path 8*b* on the discharge liquid inlet 3*f* in the left-right direction is shifted toward the inside from the ink discharge outlets 602 on the upper surface 2S of the head chip 2 (the side of the intermediate supply flow path 8*a*).

In the above-described embodiment, for example, the discharge liquid chamber 3*b* is disposed on the both sides of the supply liquid chamber 3*a* (accordingly, the intermediate discharge flow path 8*b* is disposed on the both sides of the intermediate supply flow path 8*a*), and ink supplied from the supply liquid chamber 3*a* to the head chip 2 is separated to the left and right sides in the common discharge flow path 703 and discharged to the two ejection liquid chambers 3*b*, though not limited thereto. For example, the number of the discharge liquid chambers 3*b* may be just one, and ink is supplied from a part near one end in the left-right direction to the head chip 2 and is discharged from a part near the other end to the discharge liquid chamber 3*b*.

The flow path part 8 is not limited to a structure with multiple layers of plate members, and it may be a structure with a single layered plate in which the intermediate discharge flow path 8*b* is bended or the width of the intermediate supply flow path 8*a* is varied.

Ink reflows by the water head difference in the ink reflow mechanism 9, for example, but any other mechanism that can reflows ink may be employed.

In the above-described embodiment, the recording head 1 that ejects ink as liquid is shown as the liquid ejection head, but the present invention is applicable to a liquid ejection head that ejects any liquid other than ink. For example, a liquid ejection head may eject liquid containing resin layer formation material to form a resin layer or eject liquid containing conductive layer formation material to form a conductive pattern.

The recording head 1 that uses the piezoelectric element 42 to eject ink is shown as an example, but the present invention may be applied to the recording head of another type that ejects liquid from the nozzles by change in pressure of liquid in the pressure chambers, a recording head that ejects ink by generation of air bubbles in ink by heating, for example.

In the above-described embodiment, the inkjet recording device 100 of a single-pass type is shown as an example, but the present invention may be applied to an inkjet recording device 100 that records images by scanning of the recording head 1.

Although one or more embodiments have been described, the scope of the present invention is not limited to the embodiments and includes the scope of claims below and the scope of their equivalents.

INDUSTRIAL APPLICABILITY

The present invention is applicable to a liquid ejection head and a liquid ejection device.

REFERENCE SIGNS LIST

1 Recording Head
2 Head Chip
2S Upper Surface
3 Ink Storage Part
3*a* Supply Liquid Chamber
3*b* Discharge Liquid Chamber
3*c* Inlet
3*d* Outlet
3*e* Ink Supply Opening
3*f* Discharge Liquid Inlet
3*g* Damper
3S Lower Surface
8 Flow Path Part
8*a* Supply Flow Path
8*b* Discharge Flow Path
81 Supporting Plate
81*a*, 82*a* Supply Through Hole
81*b*, 82*b*, 821*b* to 824*b* Discharge Through Hole
82, 821 to 824 Flow Path Plate
9 Ink Reflow Mechanism
10 Nozzle Plate
102 Individual Discharge Flow Path
20 Middle Plate
30 Pressure Chamber Plate
311 Pressure Chamber
40 Spacer Plate
42 Piezoelectric Element
50 Wiring Plate
60 Protection Layer
601 Ink Inlet
602 Ink Discharge Outlet
70 Common Flow Path Plate
703 Common Discharge Flow Path
100 Inkjet Recording Device
1001 Conveyance Belt
1002 Conveyance Roller
1003 to 1006 Head Unit
1007 Controller
E Extension Part
G Glue Guard
M Recording Medium
N Nozzle

The invention claimed is:

1. A liquid ejection head comprising:

a liquid ejection part comprising: a pressure chamber that stores liquid supplied from a liquid inlet formed on a predetermined first opening forming surface; a nozzle that ejects liquid supplied from the pressure chamber according to change in pressure of liquid in the pressure chamber; and a liquid discharge flow path that is branched from an ejection flow path between an inlet of liquid of the pressure chamber and an opening of the nozzle and that directs liquid supplied to the pressure chamber to a liquid discharge outlet formed on the first opening forming surface;

a liquid storage part comprising: a supply liquid chamber that stores liquid to be supplied to the pressure chamber through the liquid inlet; and a discharge liquid chamber to which liquid is directed from the liquid discharge outlet, wherein the liquid storage part has a liquid supply opening through which liquid flows out of the supply liquid chamber and a discharge liquid inlet through which liquid flows in to the discharge liquid chamber, wherein the liquid supply opening and the discharge inlet are formed on a predetermined second opening forming surface; and a flow path part that is disposed between the first opening forming surface of the liquid ejection part and the second opening forming surface of the liquid storage part and that comprises an intermediate supply flow path to direct liquid from the liquid supply opening to the liquid inlet and an intermediate discharge flow path to direct liquid from the liquid discharge outlet to the discharge liquid inlet;

wherein the intermediate supply flow path and the intermediate discharge flow path are formed such that a minimum distance between an opening of the intermediate supply flow path on a side facing the liquid storage part and an opening of the intermediate discharge flow path on the side facing the liquid storage part is greater than a minimum distance between the liquid inlet and the liquid discharge outlet on the first opening forming surface.

2. The liquid ejection head according to claim 1, wherein the flow path part comprises a layered plurality of plate members, wherein a supply through hole that forms part of the intermediate supply flow path and a discharge through hole that forms part of the intermediate discharge flow path are formed in each of the plurality of plate members.

3. The liquid ejection head according to claim 2, wherein an area of a discharge through hole of at least one plate member of the plurality of plate members is greater than an area of a discharge through hole of a plate member next to a liquid discharge part-side of the at least one plate member.

4. The liquid ejection head according to claim 1, wherein the liquid inlet comprises a plurality of liquid inlets, wherein the pressure chamber comprises a plurality of pressure chambers, wherein the nozzle comprises a plurality of nozzles, wherein the liquid ejection part comprises the plurality of liquid inlets, the plurality of pressure chambers that stores liquid supplied respectively through the plurality of liquid inlets, and the plurality of nozzles that ejects liquid supplied from the plurality of pressure chambers, wherein liquid flows in from a common opening of the intermediate supply flow path to the plurality of liquid inlets on the first opening forming surface.

5. The liquid ejection head according to claim 4, wherein the liquid discharge flow path comprises individual discharge flow paths branched from discharge flow paths corresponding to the plurality of respective nozzles, and one or more common discharge flow paths communicating to two or more of the individual discharge flow paths and directing liquid in the two or more individual discharge flow paths to the liquid discharge opening.

6. The liquid ejection head according to claim 1, wherein the intermediate discharge flow path comprises a first intermediate discharge flow path and a second intermediate discharge flow path on an opposite side of the intermediate supply flow path from the first intermediate discharge flow path in the flow path part, wherein the discharge liquid inlet comprises discharge liquid inlets corresponding respectively to the first intermediate discharge flow path and the second discharge flow path.

7. The liquid ejection head according to claim 1, wherein the flow path part is bonded to at least one of the first opening forming surface and the second opening forming surface with an adhesive agent, wherein a flow area limiter to limit a flowable area of the adhesive agent is disposed on a surface of the flow path part that is bonded to the first opening forming surface and/or the second opening forming surface with the adhesive agent.

8. The liquid ejection device comprising the liquid ejection head according to claim 1.

* * * * *